US007568909B2

(12) United States Patent
MacNutt et al.

(10) Patent No.: US 7,568,909 B2
(45) Date of Patent: Aug. 4, 2009

(54) BURNER IGNITION AND CONTROL SYSTEM

(75) Inventors: Rob MacNutt, Okotoks (CA); Gary Gunthorpe, Calgary (CA)

(73) Assignee: Platinum Energy Services Corp., Calgary (CA)

( * ) Notice: Subject to any disclaimer, the term of this patent is extended or adjusted under 35 U.S.C. 154(b) by 301 days.

(21) Appl. No.: 10/997,923

(22) Filed: Nov. 29, 2004

(65) Prior Publication Data

US 2005/0130086 A1 Jun. 16, 2005

Related U.S. Application Data

(60) Provisional application No. 60/525,881, filed on Dec. 1, 2003.

(51) Int. Cl.
*F23N 5/00* (2006.01)

(52) U.S. Cl. ..... 431/69; 431/74; 431/75; 431/27

(58) Field of Classification Search ..... 431/69, 431/70, 71, 72, 6, 24, 27, 74, 75, 77; 122/14.2, 122/14.21

See application file for complete search history.

(56) References Cited

U.S. PATENT DOCUMENTS 4,131,413 A * 12/1978 Ryno ..... 431/44
4,197,082 A * 4/1980 Matthews ..... 431/25
4,243,373 A * 1/1981 Fernstrom et al. ..... 431/66
4,260,362 A * 4/1981 Matthews ..... 431/69
4,399,537 A 8/1983 Jones
4,403,765 A 9/1983 Fisher
4,442,853 A * 4/1984 Gort ..... 137/66
4,538,129 A 8/1985 Fisher
4,695,246 A * 9/1987 Beilfuss et al. ..... 431/31
4,778,378 A * 10/1988 Dolnick et al. ..... 431/79
5,031,209 A 7/1991 Thornborough et al.
5,193,587 A 3/1993 Miller, Jr.
5,603,315 A 2/1997 Sasso, Jr.
5,718,256 A 2/1998 Buezis et al.
5,960,813 A * 10/1999 Sturman et al. ..... 137/78.3
6,089,856 A 7/2000 Wolcott et al.
6,273,394 B1 8/2001 Vincent et al.
6,280,180 B1 * 8/2001 Fredin-Garcia-Jurado et al. ..... 431/27
6,892,746 B2 * 5/2005 Ford ..... 137/1

* cited by examiner

*Primary Examiner*—Kenneth B Rinehart
*Assistant Examiner*—Chuka C Ndubizu
(74) *Attorney, Agent, or Firm*—Sean W Goodwin; Linda M. Thompson

(57) ABSTRACT

A battery powered ignition and control system for a gas burner includes circuits for controlling a pilot burner, a main burner, a flame sensor and an igniter. Mechanically latched valves, which require power only to switch between and open and closed state are used to control the pilot and main gas. The circuitry spends a majority of time in a powered down state and draws power only when required to interrogate the state of the flame and to perform an ignition sequence as required, as periodically dictated by a watchdog system. The latching valves are electrically pulsed to change state and thus draw very low average power when called upon. Lithium batteries provide system power for a long duration.

14 Claims, 3 Drawing Sheets

BURNER IGNITION AND CONTROL SYSTEM

CROSS REFERENCE TO RELATED APPLICATION

This application claims priority of U.S. provisional application Ser. No. 60/525,881, filed Dec. 1, 2003, the entirety of which is incorporated herein by reference.

FIELD OF INVENTION

Embodiments of the invention relate to gas burner controls for gas heaters and the like, and in particular to a new and novel way to power and control said burner such that the system draws very low average electrical power.

BACKGROUND OF THE INVENTION

A specialized type of heater apparatus is conventionally used for heating natural gas pipelines. The requirement for such heaters arises as a result of the possibility for condensation of water and hydrocarbon vapors, entrained in the natural gas, which can produce hydrates and resulting problems therefrom. The problem is conventionally avoided by heating the pipeline gas through the use of the specialized pipeline heater.

The need for pipeline heaters typically arises in locations along the pipeline or at well sites that are remote and often without an electrical supply available to operate conventional heaters. Typical types of such heaters include direct or indirect fired heaters, most often for heating a heat-transferring substance such as glycol, by a gas burner. The gas burner is ignited by a pilot light, the pilot light being a smaller gas burning flame.

Conventional heaters in use today often comprise manually operated pilot flame ignition systems without safety features for providing reliable re-lighting of an extinguished pilot flame. The heaters also include thermally operated main burner shut-off features. Therefore, the burners presently used are not reliable for avoiding condensation in the pipeline, and do not have the much needed safety features for detecting and reacting to burner pilot flame failure. Further, the burners presently used have continual pilot flames, regardless of infrequent burner use, resulting in wasted fuel due to unnecessary pilot burn time.

Burner controls and spark igniter devices are known and available for heaters used in other industries where the availability of power is not an issue. However, in industries where power is not readily available, such as in the case of pipelines, control and ignition remains an issue.

In order for electrically ignited gas burners to operate as stand-alone units without the need for connection to line voltage, attempts have been made to use electrical storage batteries for use as the power supply to the ignition circuits. Examples of such systems are taught in U.S. Pat. Nos. 3,174,534 and 3,174,535 to Weber and in U.S. Pat. No. 4,131,413 to Ryno. The Weber patents teach applying the battery power through an oscillation circuit across a transformer which supplies power to a spark gap. The battery is recharged after ignition by a thermopile charger, which receives energy from the flame. The Ryno patent similarly uses a battery supply which is recharged by a thermopile. Another concept available in the industry is to use solar energy to recharge the batteries.

While the introduction of rechargeable batteries, recharged by thermopiles or solar, is significant because gas burners are relatively maintenance-free over a lifetime of 15 years or more, the recharging circuit and rechargeable battery greatly increases the cost and complexity of the system. In addition, rechargeable batteries have a life expectancy of only three to five years and typically have performance issues in cold temperature operation and storage.

SUMMARY OF THE INVENTION

In accordance with embodiments of the present invention, a control system is taught which minimizes a requirement for energy consumption by implementing a timer or watchdog system into a control system which requires minimal power to periodically interrogate a state of a device being controlled. When the control system senses an operational state, it returns to sleep. When the control system senses a non-operational state, it momentarily utilizes energy to trigger one or more latches to change state, causing the device to be made operational and then returns to sleep. Additionally, should the device not be made operational as a result of the activation of the latch, further sensing of a non-operational state would cause the system to be shut down by momentarily energizing the latch.

In a burner implementation, the state of gas valves can be altered with the momentary energizing of latching valves based on sensing flame states, such as the operational presence of a flame or the non-operational absence of a flame. The watchdog timer is an extremely low powered alarm clock-like timer circuit which, at periodic intervals, interrogates the flame sensor regarding the presence or absence of flame.

More particularly, in one embodiment, a long-life energy source such as a lithium battery is utilized as the power source to switch the latching valves. To minimize the current drain from the battery, all of the circuits including the control valves remain un-energized except for the brief time required to change the state of the latching valves. As the current drain from the battery is required only to change the state of the latching valves and is not required to maintain the latch once it has been switched, the battery life is extended resulting in less frequent replacement or recharging.

In the burner control implementation, the control system of an embodiment of the invention utilizes conventional components of a burner control and ignition system and valve control systems including a main burner valve for providing gas to the main burner and a pilot valve for providing gas to the pilot burner. Further, a flame sensor and a flame sensor circuit provide a flame signal. Ignition electrodes and an ignition circuit drive the electrodes to produce a spark during lighting of the pilot burner. A first switching circuit is used for controlling the ignition circuit and the main burner.

Small latching valves, typically being mechanical devices including alternating magnetically latched states which consume only minute amounts of energy to switch from open to closed states, are used to control larger pneumatically-powered valves for the main burner gas. If the flame is detected, the circuit immediately powers off. If flame is not detected, the circuit reacts accordingly to disable all gas flow and then powers off or alternatively, the circuit may try to relight the flame. In any case, power is only on for sub-second durations. As a safety feature in the event that the flame fails to ignite after a predetermined amount of time or during normal operation, the control system disables the gas flow to the burner.

DETAILED DESCRIPTION OF THE PREFERRED EMBODIMENTS

Embodiments of the invention utilize at least one latch which is operable between an open state and a closed state and which utilizes minimal power to switch between states and virtually no power therebetween. Further, power is not required to maintain the latch in either state once switched. Minimum power usage is achieved by a timer which actuates a sequence of events to determine the operation or state of an apparatus at period intervals. When the apparatus is detected to be in a first state, the latch is maintained in the open state, without the need to apply power to maintain it in that state. If the apparatus is determined to be in a second state, the latch is switched to the closed state. Each time the latch or latches are switched only a momentary application of power operable only for switching between states is required, thus power is conserved.

Figure 1:
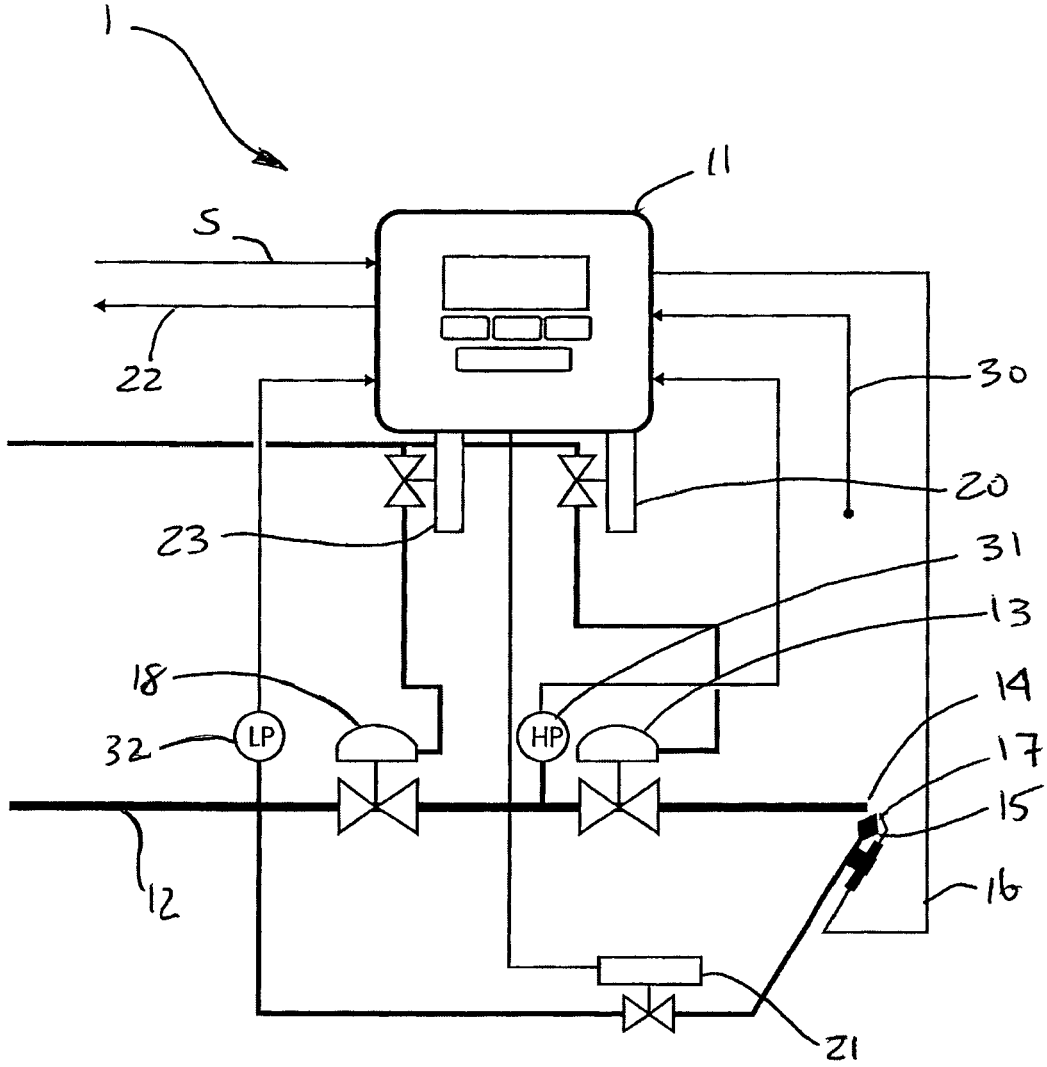
FIG. 1 is a schematic of an alternate embodiment of a burner control system of the present invention having a main gas valve controlled by a main latching valve and a pilot flame latching valve for providing gas directly to a pilot flame.

Having reference to FIG. 1, a burner control system 10 embodiment is shown. The system 1 comprises a controller 11 which incorporates a watchdog system or timer (not shown), a main burner valve 13 to provide a flow of gas from a main gas supply 12 to the main burner 14. Typically, the main gas supply 12 also feeds the pilot burner 15. A flame sensor 16 continuously monitors the pilot burner 15 for the presence of a flame and may monitor the main burner 14. An igniter 17, typically a high voltage igniter, is positioned adjacent the pilot burner 15 for igniting the pilot burner 15.

Actuation energy, typically a pressurized gas flow such as from the main gas supply 12 or alternatively instrument air, is provided to pneumatically operate the main burner valve 13, and optionally, additional pneumatic valves, such as an emergency shutdown (ESD) valve 18, connected upstream of the main burner valve 13.

Actuation of the main burner valve 13 is controlled by a magnetic latching valve 20. Typically, the main burner valve 13 is a slave valve to the latching valve 20 as the latching valve 20 may not have enough gas flow capacity therethrough. Further, the flow of gas to the pilot burner 15 is controlled by a latching valve 21. Latching valves 20,21 are controlled by a pulse of electrical energy from a controller 11. When a pulse of electrical energy is applied to either of the latching valves 20,21, the state changes from open state to closed state or from a closed state to open state depending on the polarity of the pulse. In the open state, actuation energy is directed from the latching valve 20 and applied to the corresponding gas valve.

When the main gas latching valve 20 is in the open state, it permits the main gas supply 12 pressure, or alternatively instrument air, to be applied to the actuation bellows of the main gas valve 13, thus pneumatically opening the main gas valve 13 which flows gas from the main gas supply 12 to a main burner 14 and enables the combustion process to provide heat.

When the pilot flame latching valve 21 is in the open state, it allows gas from the main gas supply 12 to be directed to the pilot burner 15 to provide a source of ignition gas, which when ignited produces a flame for igniting the main burner 14.

Figure 2:
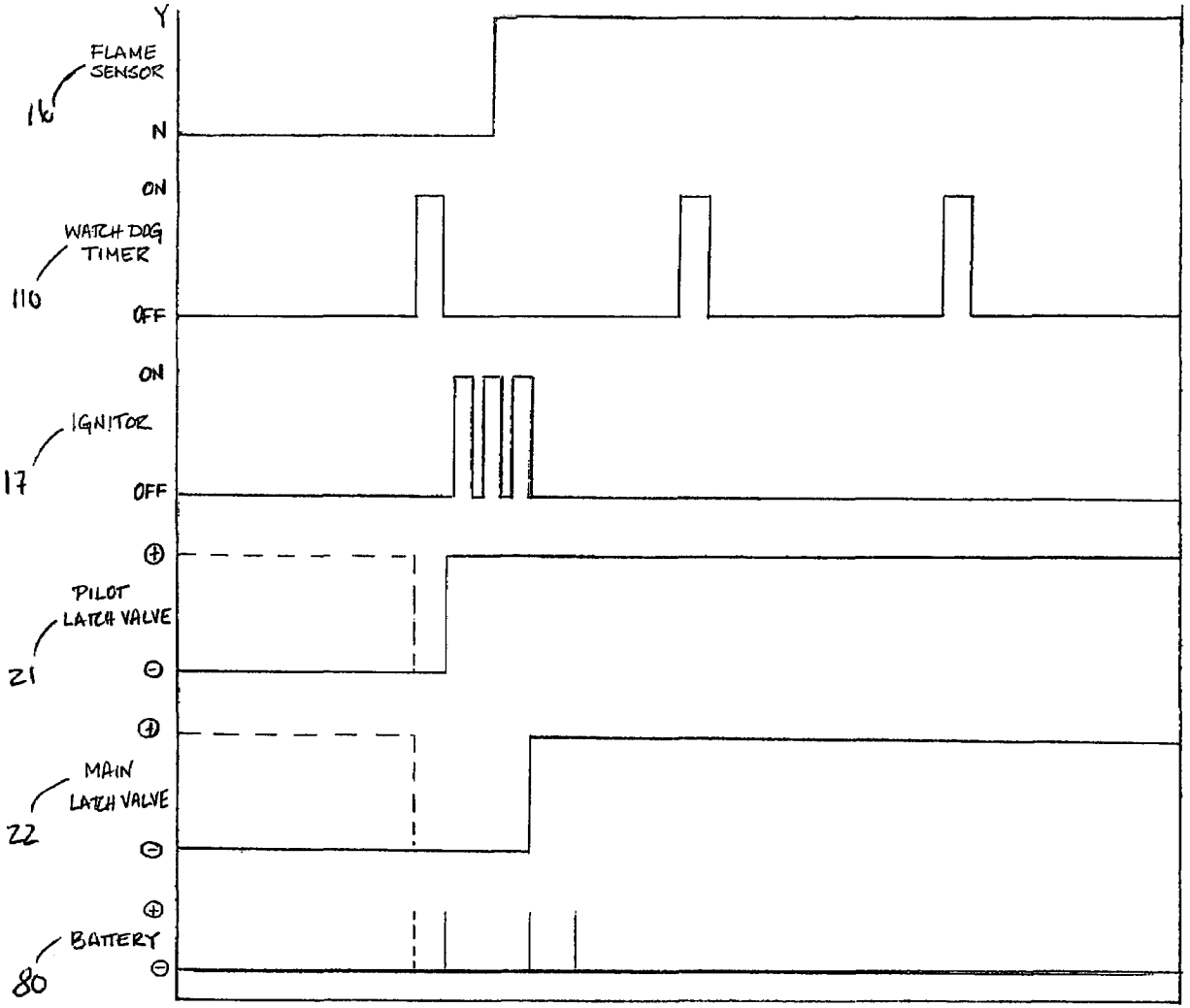
FIG. 2 is a schematic illustrating operation of components according to FIG. 1 of the burner control system in normal operation, shown in solid lines, and in the event of loss of flame, as shown in dashed lines.

Having reference to FIGS. 1 and 2, a watchdog timer circuit 110, at periodic, timed intervals, enters an active phase and signals the controller 11 to interrogate the pilot burner 15, using the flame sensor 16, for the presence of a flame. If the flame sensor 16 senses a first state, the presence of a flame, the controller 11 subsequently turns the power off and the system 1 remains dormant until the next timed interval and the watchdog timer circuit 100 enters an inactive phase. If the flame sensor 16 senses a second state, the absence of a flame, the controller 11 initiates an ignition sequence to relight the pilot burner 15.

In the ignition sequence, the latching valves 20, 21 are initially and momentarily powered to the closed state to stop the flow of gas thereto. After a predetermined interval to permit the dispersion or purging of any gas present in the system, the latching valves 20, 21 are momentarily powered to switch to the open state to permit gas to flow thereto and the igniter 17 is powered to ignite the pilot burner 15 and ultimately the main burner 14. The flame sensor 16 monitors the pilot burner 15 for the presence of flame and if the ignition was successful and a flame is detected the controller 11 shuts the power off and becomes dormant until the next interval. If however, the ignition was not successful and no flame is detected the ignition sequence will be repeated. Preferably, the ignition sequence will be attempted 3 times and if unsuccessful each time, the latching valves 20,21 will be momentarily powered to the closed state to shut off the flow of gas thereto and an alarm will be sent via an alarm relay 22.

In another embodiment, as required by pertinent regulations, at least one pneumatic ESD valve 18 is powered by an ESD latching valve 23. The ESD latching valve 23 is powered to the open state to permit the flow of gas to the main burner valve 13. In the event that the controller 11 receives a signal S that the system must be shutdown, the ESD latching valve 23 is momentarily powered to the closed state to close the at least one pneumatic ESD valve 18 and the flow of gas from the main gas supply 12 is stopped, regardless the state of the main burner valve 13.

Further, a temperature sensor 30, preferably a 1000 ohm resistance-temperature detector (RTD), is provided to monitor the process temperature. If the temperature is above a setpoint range, the controller 11 momentarily powers the main burner latching valve 20 to shut off the main burner valve 13 until such time as the temperature returns to the setpoint range.

Further, a high pressure switch 31 and a low pressure switch 32 monitor the pressure in the main gas supply 12 and should the pressures rise or fall from a preset range of pressures, resulting in either of the switches 31 being switched on, an alarm is sent via the alarm relay 22

Figure 3:
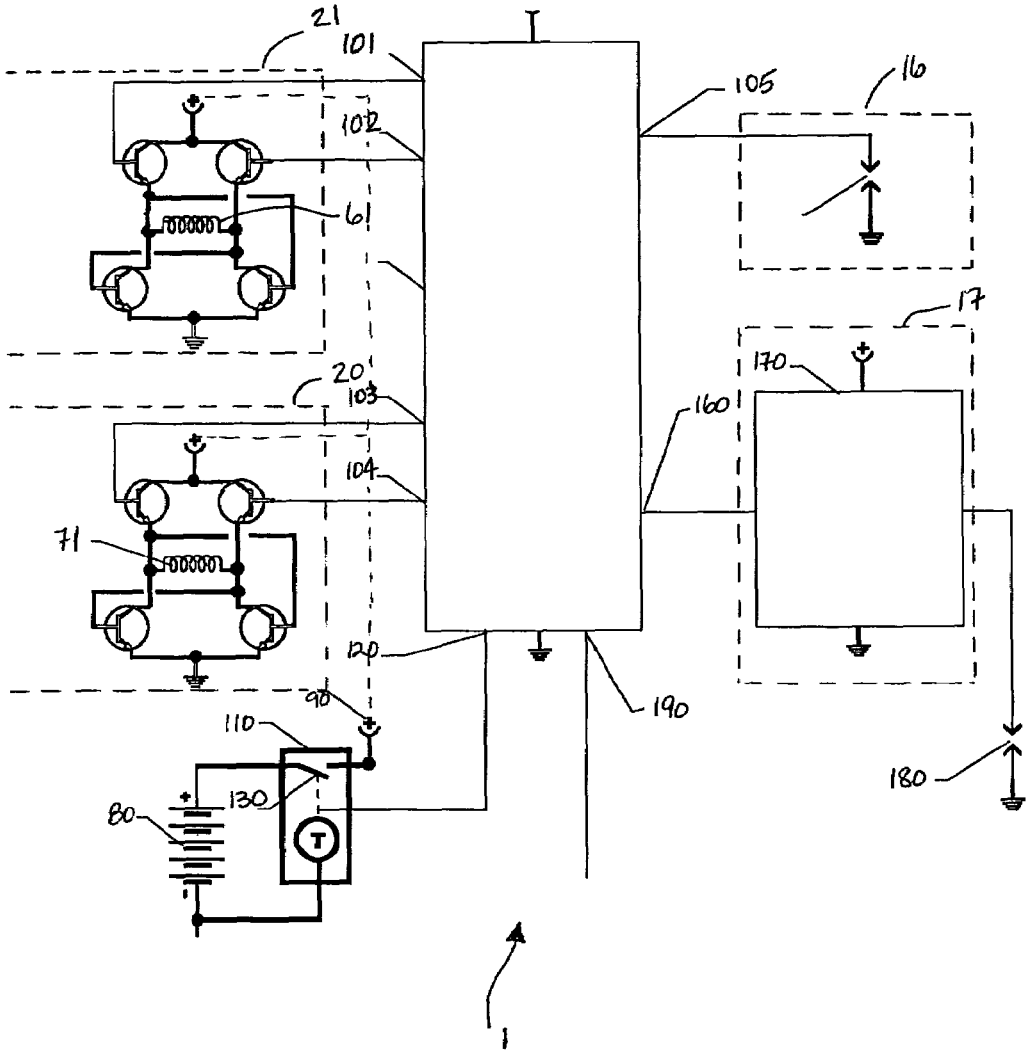
FIG. 3 is a schematic of a controller and power circuits according to FIG. 1.

FIG. 3 illustrates a simplified schematic of an embodiment of the control system 1. A microcomputer 100, including program memory, RAM, port controls, analog to digital converters, and other support circuitry, controls the system 1 operations. The pilot flame latching valve 21 is opened by the microcomputer 100 pulsing line 101 low which causes an H-bridge to drive a current pulse through the pilot latching valve's coil 61 in the opening direction. The pilot flame latching valve 60 is closed by the microcomputer 100 pulsing line 102 low which causes an H-bridge to drive a current pulse through the valve's coil 61 in the closing direction.

The main gas latching valve 20 is opened by the microcomputer 100 pulsing line 103 low which causes an H-bridge to drive a current pulse through the valve's coil 71 in the opening direction. The main gas latching valve 20 is closed by the microcomputer 100 pulsing line 104 low which causes an H-bridge to drive a current pulse through the valve's coil 71 in the closing direction.

The microcomputer 100 detects flame through line 105, which is connected to the flame sensor 16. In a preferred embodiment, the flame sensor 16 is a flame ionization detector which draws no power.

The microcomputer 100 controls the igniter 17, typically a high voltage circuit 170 via line 160. The high voltage circuit 170 causes a pulsating high voltage current to be applied to a spark gap 180 in the proximity of a nozzle (not shown) of the pilot burner 15.

A microcontroller, or low power watchdog timer circuit 110, controls the power for the system 1. Power from a battery 80 is connected to the latching valve's control circuits 90 via a switch 130. At prescheduled intervals, switch 130 is closed by the watchdog timer circuit 110. Switch 130 is opened by the microcomputer 100 through line 120 when the microcomputer 100 has completed the interval interrogation using the flame sensor 16 and the ignition sequence, if required. In operation, the switch 130 is closed several times per second by timer 110. In a preferred embodiment, the timer 110 is internal to the microcomputer 100.

If flame is detected at the flame sensor 16, all is operating properly, and the microcomputer 100 opens switch 130, thus turning the power off to the control circuits 90. If no flame is detected, the microcomputer 100, checks for a demand for heat through line 190, and if so the main burner 14 needs to be restarted. Microcomputer 100 closes both latching valves 20, 21 and waits a prescribed amount of time to clear the area of gas. The microcomputer 100 then actuates the pilot flame latching valve 21 and shortly thereafter activates the igniter circuit 170 to ignite the pilot gas flow. Subsequently, following ignition and when a flame is detected, the igniter circuit 170 is turned off and the main gas latching valve 20 is opened. Typically the pilot flame latching valve 21 is left open, however, in some other instances, an operator may wish to also close the pilot flame latching valve 21 and pilot gas flow on proof of ignition of the main gas burner 13. The microcomputer 100 then opens switch 130, turning off the power.

There may be many different operational scenarios for the burner, all of which rely on at least one latching valve.

The invention claimed is:

1. A burner control system for ensuring continuous operation of a remote heater having a gas supply and no access to a utility electrical supply comprising:

a main burner and a pilot burner in the remote heater;

an igniter for igniting the pilot burner;

a flame ionization detector for sensing at least a pilot flame at the pilot burner;

a pilot latching valve for controlling gas flow from the gas supply to the pilot burner, the pilot latching valve being operable between an open state wherein gas is supplied to the pilot burner and a closed state in which the flow of gas to the pilot burner is stopped;

a main latching valve for controlling a main gas valve, the main latching valve being operable between an open state in which the main gas valve is caused to be opened wherein gas is supplied to the main burner and a closed state in which the main gas valve is caused to be closed in which the flow of gas to the main burner is stopped;

a control circuit having a microcomputer for controlling the pilot and main latching valves between their open and closed states, for interrogating the flame ionization detector, and for operating the igniter;

a battery;

a microcontroller timer powered by the battery; and a switch, closed by the microcontroller timer at timed intervals for momentarily powering the control circuit from the battery, the microcomputer interrogating the flame ionization detector for detecting the at least the pilot flame, wherein when the at least the pilot flame is detected, the microcomputer opens the switch for turning off the control circuit, minimizing current drain in the battery; and when the at least the pilot flame is not detected, the microcomputer restarts the main burner, wherein the microcomputer momentarily powers the pilot and main latching valves by the battery to switch to the closed state;

the microcomputer momentarily powers the pilot latching valve by the battery to switch to the open state;

the microcomputer momentarily powers the igniter by the battery to light the pilot burner and, if the flame ionization detector senses the at least the pilot flame;

the microcomputer momentarily powers the main latching valve to switch the main latching valve to the open state to supply gas to the main burner; and the microcomputer opens the switch for turning off the control circuit, for minimizing current drain in the battery, until the next timed interval.

2. The burner control system of claim 1 wherein the battery is a lithium battery.

3. The burner control system of claim 1 wherein the remote heater is one of either a direct or indirect fired heater.

4. The burner control system of claim 1 comprising:

at least one emergency shutdown valve between the main gas supply and the main gas valve; and an emergency shutdown latching valve controlling the at least one emergency shutdown valve, the latching valve being momentarily powered between an open state wherein the at least one emergency shutdown valve is open to permit the flow of gas from the gas supply to the main gas valve and a closed state in which the at least one emergency shutdown valve is closed.

5. The burner control system of claim 4 wherein the at least one emergency shutdown valve controls the flow of gas from the gas supply to both the main gas valve and the pilot latching valve.

6. The burner control system of claim 1 further comprising:

a temperature sensor for monitoring a process temperature, wherein when the process temperature exceeds a setpoint range, the microcomputer momentarily powers the main latching valve to the closed state in which the main gas valve is caused to be closed.

7. The burner control system of claim 1 further comprising a low pressure sensor and a high pressure sensor for monitoring a pressure in the flow of gas.

8. The burner control system of claim 1 wherein the remote heater is a pipeline heater having no access to the electrical supply.

9. The burner control system of claim 1 wherein the microcontroller timer is internal to the microcomputer.

10. A method for ensuring continuous operation of a remote heater having no access to an electrical supply comprising:

providing a remote heater having a main burner, a pilot burner, a gas supply, a main gas valve for providing a flow of gas from the gas supply to the main burner, and an igniter for igniting the pilot burner powering a microcontroller timer by a battery;

periodically closing a switch at timed intervals by the microcontroller timer, for momentarily powering a control circuit having a microcomputer;

interrogating a flame ionization detector by the microcomputer for detecting a flame;

wherein, when the flame is detected, opening the switch, by the microcomputer, for turning off the control circuit, for minimizing current drain in the battery; and when the flame is not detected, momentarily powering a pilot latching valve, by the microcomputer, for actuating the pilot latching valve to a closed state for stopping a flow of gas from the gas supply to the pilot burner;

momentarily powering a main latching valve, by the microcomputer, for actuating the main latching valve to a closed state in which the main gas valve is caused to be closed for stopping the flow of gas to the main burner;

momentarily powering the pilot latching valve, by the microcomputer, for actuating the pilot latching valve to an open state wherein gas is supplied to the pilot burner;

momentarily powering the igniter, by the microcomputer, to light the pilot burner, and, when the flame is detected;

momentarily powering the main latching valve, by the microcomputer, for actuating the main latching valve to an open state in which the main gas valve is caused to be opened and wherein gas is supplied to the main burner; and opening the switch, by the microcomputer, for turning off the control circuit, for minimizing current drain in the battery, until the next timed interval.

11. The method of claim 10 wherein the battery is a lithium battery.

12. The method of claim 10 wherein the remote heater in one of either an indirect or direct fired heater.

13. The method of claim 10 wherein the remote heater is a pipeline heater having no access to the electrical supply.

14. The method of claim 10, wherein when the flame is not detected following the step of momentarily powering the main and pilot latching valves to the closed state, further comprising waiting a prescribed period of time for gas to clear from the remote heater.

* * * * *